US005939662A

United States Patent [19]

Bootes et al.

[11] Patent Number: 5,939,662

[45] Date of Patent: Aug. 17, 1999

[54] MISSILE WARHEAD DESIGN

[75] Inventors: Thomas H. Bootes, Tucson, Ariz.; Mel Castillo, San Diego, Calif.

[73] Assignee: Raytheon Company, Lexington, Mass.

[21] Appl. No.: 08/984,100

[22] Filed: Dec. 3, 1997

[51] Int. Cl.[6] ..... F42B 12/04; F42B 12/20

[52] U.S. Cl. ..... 102/473; 102/293; 102/481; 102/499; 102/517

[58] Field of Search ..... 102/293, 308, 102/382, 389, 374, 376, 473, 481, 499, 500, 514, 516–519

[56] References Cited

U.S. PATENT DOCUMENTS

| | | | |
|---|---|---|---|
| H1235 | 10/1993 | Canaday | 102/473 |
| 1,502,925 | 7/1924 | Stone | 102/517 |
| 1,861,054 | 5/1932 | Hadfield et al. | 102/517 |
| 2,120,913 | 6/1938 | Studler | 102/516 |
| 2,364,643 | 12/1944 | Moore et al. | 102/499 |
| 2,434,452 | 1/1948 | Barber | 102/389 |
| 2,682,224 | 6/1954 | Braverman | 102/507 |
| 3,349,708 | 10/1967 | Paget | 102/374 |
| 3,545,383 | 12/1970 | Lucy | 102/517 |
| 3,693,548 | 9/1972 | Dereich et al. | 102/382 |
| 4,615,272 | 10/1986 | Aubert | 102/481 |
| 5,038,686 | 8/1991 | Zulkoski et al. | 102/481 |
| 5,233,929 | 8/1993 | Spahn | 102/475 |
| 5,468,313 | 11/1995 | Wallace, II et al. | 149/53 |
| 5,528,990 | 6/1996 | Corzine et al. | 102/517 |
| 5,786,544 | 7/1998 | Gill et al. | 102/481 |

FOREIGN PATENT DOCUMENTS

| | | | |
|---|---|---|---|
| 887124 | 1/1962 | United Kingdom | 102/517 |

*Primary Examiner*—Harold J. Tudor

*Attorney, Agent, or Firm*—Glenn H. Lenzen; Andrew J. Rudd; William J. Benman

[57] ABSTRACT

A hard-target penetrating warhead (10) adapted for use with length constrained warhead payload bays. The warhead (10) includes a warhead case (12) for containing warhead explosives (22, 27). A tungsten ballast (16) is disposed within the case (12) for providing a high warhead sectional pressure upon impact of the warhead (10) on a target. A fuse (19) detonates the warhead explosives (22, 27) upon penetration of the target. The fuse (19) is housed by a fuse well (18) that is attached to the case (12) at one end. A slip fit section of the fuse well (18) provides structural support to the case (12) and prevents dislodging of the fuse well (18) and the fuse (19) from the case (12) upon warhead target impact. Explosives blowout ports (24) included in the fuse well (18) inhibit undesirable explosion or detonation of the warhead explosives (22, 27) by accidental exposure to high heat or fire. In a specific embodiment, the case (12) has a 6 caliber radius head nose (14). The explosives blowout ports (24) include main explosives blowout ports (24) for allowing the heat to burn the warhead explosives (22) and vent gases resulting from the burning. The main explosive blowout ports (24, 25) are placed around a circumference of the fuse well (18) and include nine ports having a surface area designed to minimize danger of explosion and/or detonation in the event of an accidental fire. The blowout ports (24, 25) also include booster blowout ports (25) for allowing safe burning of booster charge explosives (27) included in the fuse (19). Additionally, a special polyethelene/polyalphaolefin liner (20) lines the inside of the case (12) and improves fast cook-off safety performance. In the illustrative embodiment, the warhead explosives (22) include PBXN-109. The case (12) includes a textured or grooved surface that facilitates bonding of the ballast (16) to the case (12).

11 Claims, 4 Drawing Sheets

MISSILE WARHEAD DESIGN

BACKGROUND OF THE INVENTION

1. Field of Invention

This invention relates to missiles. Specifically, the present invention relates missile warheads designed to penetrate hard targets.

2. Description of the Related Art

Missiles are used in a variety of demanding applications ranging from air to air and ground combat applications to structural demolition applications. Such applications often require missiles with warheads that can effectively and consistently penetrate and explode within hard targets and that may be safely transported and stored with minimal explosion danger.

A typical hard target missile includes an explosive warhead enclosed within a steel case. A fuse serves to ignite the explosive warhead following target impact. When a warhead penetrates a target, the fuse detonates a booster charge which in turn detonates the explosives in the warhead. At high target impact velocities and oblique impact angles, existing warheads may experience a slap down effect. The slap down effect causes the missile warhead case to become oval shaped as the missile slaps against the target. As a result, the fuse located in the end of the missile warhead case may become dislodged, preventing warhead detonation. Also, the warhead will often fail to adequately penetrate and destroy a target due to inadequate missile velocity or due to structural feature of the warhead that limit warhead sectional pressure. (Sectional pressure is related to the pressure that a warhead exerts on a target at impact and is expressed in terms of weight per unit area). An example of such a structural feature that can limit the penetration of a warhead is the larger diameter warhead case used on traditional warheads.

To improve warhead target penetration, designers attempted to increase missile velocity. However, this proved expensive and difficult due to missile delivery system limitations and existing missile payload length constraints.

In addition, missiles are often launched from a variety of Navy and Air Force launch platforms. The capacity of these launch platforms acts as a missile design constraint limiting the length and diameter of the missiles.

During worst case storage or transport conditions, the warheads may be exposed to fire or other extreme heat, creating hot spots in the explosive fill. These hot spots may lead to unintentional warhead detonation.

To increase missile safety, designers often employ stress risers. A stress riser is implemented via a groove in the missile case. When the case is exposed to fire or another heat source, the explosives expand and crack the missile case at the groove. The explosives then slowly burn and vent through the crack in the missile case, thereby avoiding undesirable detonation of missile explosives. The stress riser however, acts as a failure joint upon warhead hard target impact. This reduces target penetrating capability.

Hence, a need exists in the art for a safe and cost effective warhead adaptable to existing missile payload sections that can reliably and consistently penetrate a wide variety of hard targets.

SUMMARY OF THE INVENTION

The need in the art is addressed by the hard-target penetrating warhead of the present invention. In the illustrative embodiment, the inventive system is adapted for use with length constrained missile payload bays and includes a warhead case for containing explosives. A tungsten ballast is inserted within the case to provide a high warhead sectional pressure upon impact of the missile against a target. A fuse detonates the warhead explosives following penetration of the target. A fuse well houses the fuse and is attached to the case at one end. A slip fit section of the fuse well provides structural support to the case and prevents dislodging of the fuse well and the fuse from the case upon missile target impact. Explosives blowout ports included in the fuse well inhibit undesirable detonation of the warhead explosives by accidental exposure to high heat.

In a specific embodiment, the case includes a 6 caliber radius head nose. The fuse well includes main explosives blowout ports for allowing accidental exposure to high heat to burn the missile explosives and safely vent gases resulting from the burning. The main explosives blowout ports are placed around a circumference of the fuse well and include nine ports having a surface area designed to prevent undesirable detonation. The blowout ports also include booster blowout ports for allowing safe venting of booster charge explosives that are included in the fuse. Additionally, a special polyethelene/polyalphaolefin liner lines the inside of the case for improving safe venting performance under fast cook-off hazardous conditions. The warhead explosives include PBXN-109. The case includes a textured or lightly grooved surface for facilitating bonding of the ballast to the case.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
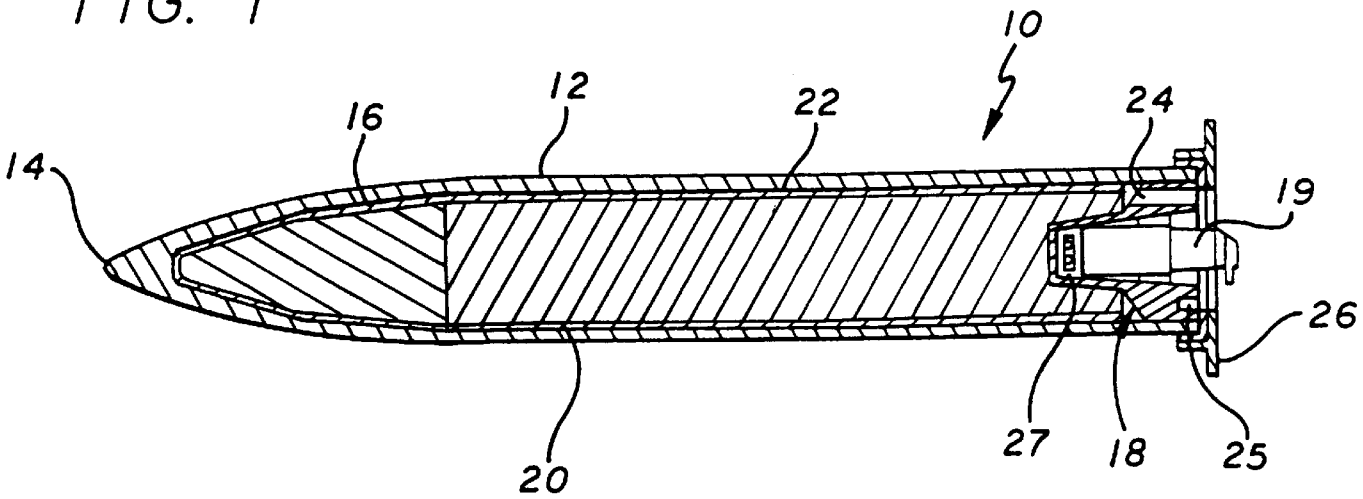
FIG. 1 is a cross-sectional diagram of a warhead constructed in accordance with the present invention.

FIG. 1 is a cross-sectional diagram of a warhead 10 constructed in accordance with the present invention. The warhead 10 includes a case 12 having a special nose 14, a tungsten ballast 16 inserted within the case 12 near the special nose 14, a unique fuse well 18 at the opposite end of the case 12, an internal liner 20, and specially selected high explosives 22 surrounded by the liner 20.

The case 12 is a 330 pound penetrating thick-walled case constructed of 4340 mod aircraft quality steel alloy. The special nose 14 is a 6 caliber radius head nose (6 CRH, an arc with a radius of 6 times the diameter of the warhead) designed for maximum warhead penetration. The tungsten ballast 16 weighs approximately 240 pounds, and in combination with the nose 14 results in very high warhead sectional pressure. The tungsten ballast 16 and the special nose 14 provide significantly more target penetration than existing warheads whose lengths are constrained by payload bays or other factors.

The tungsten ballast 16 is approximately 2.4 times more dense than steel facilitating a shift of the center of gravity of the warhead forward and allowing carriage of up to 40% more explosives. By selectively concentrating missile mass near the nose of the warhead 10, warhead terradynamic stability is enhanced which improves warhead penetration, and in turn expands the target set, i.e., the set of targets that may be successfully attacked by the warhead 10 carrying more explosives. For example, the warhead 10 may be used to attack hardened or layered targets whereas comparable length constrained missiles are often ineffective at penetrating and destroying these targets.

The special liner 20 is a polyethylene/polyalphaolefin film that surrounds the explosives 22. The liner 20 may be sprayed or poured on the interior of the case 12 before missile assembly. The liner 20 helps reduce the probability that the explosives 22 will unintentionally detonate due to exposure to any accidental external heat source.

To further increase the safety of the warhead 10, a fuse body 19 includes explosives blowout ports 24. The ports 24 allow heat to enter the fuse body 19 and slowly burn booster charge explosives 27. The process by which the main explosives 22 burn is known as a 'cook-off'. In the event of a fire, the explosives 22 burn-off quickly without exploding. If the explosives 22 are not allowed to burn, resulting hot spots in the explosives 22 may lead to unintentional warhead detonation. Booster charge blowout ports 25 allow for fast cook-off burning of the booster charge explosives 27.

The fuse well 18 screws into the case 12 and is uniquely designed to provide additional structural support to the case 12 (as discussed more fully below) thereby preventing undesirable dislodging of the fuse well 18 from the warhead 10. A retention plate 26 screws onto the end of the warhead 10 and helps to secure the warhead case 12 in the missle payload bay (see 72 of FIG. 7). In the present specific embodiment, the fuse well 18 is designed to accommodate a standard FMU-148/B fuse 19.

The warhead 10 is part of a missel system (not shown) that includes a guidance control system having a guidance control processer and aerodynamic fins, and a proplusion system having an engine and fuel system.

Figure 2:
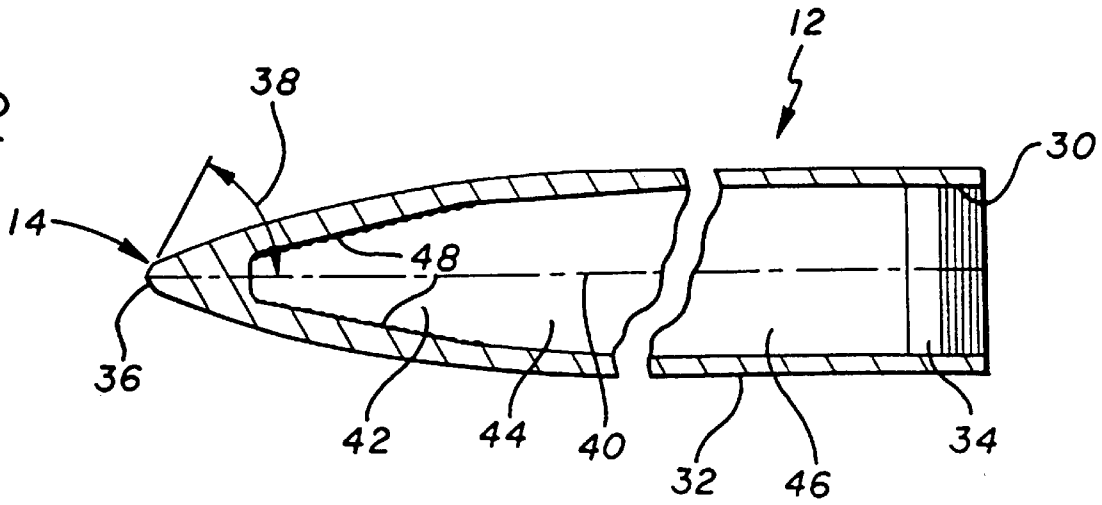
FIG. 2 is a more detailed cross-sectional diagram of the case of the warhead of FIG. 1.

FIG. 2 is a more detailed cross-sectional diagram of the case 12 of the warhead 10 of FIG. 1. In the present specific embodiment, the case 12 is adapted for use with Tomahawk payload sections and includes inside threads 30 that extends approximately 1.5 inches from the end of the case 12. Threads on the outside of the fuse well (see FIG. 1) match the threads 30.

The case 12 has a main cylindrical body 32 having an outside and inside diameter of approximately 8.7 inches 7.2 inches, respectively. A fuse well slip fit section 34 of the body 32 has an inside diameter of approximately 7.214 inches. The slip fit section 34 is designed to accommodate a corresponding slip fit section of the fuse well as discussed more fully below.

In the present specific embodiment, the case 12 is 61.5 inches long and is constructed of aircraft quality 4340 steel alloy heat treated to Rockwell C40 +/−2, per MIL-H-6875. The nose 14 includes a conical bevel 36 the surface of which forms an angle 38 of approximately 62.5 degrees with respect to a longitudinal missile axis 40.

The case 12 includes a first cavity section 42 that begins approximately 4.5 inches from the end of the nose 14 and extends approximately 9 inches. The first cavity section 42 is shaped like a section of a cone having a vertex angle of approximately 25.1 degrees. The first cavity section 42 ends to where the case 12 has an inside diameter of approximately 6.0 inches where a second cavity section 44 begins. The second cavity section 44 extends 8.0 inches along the longitudinal axis 40 and ends where the case 12 has an inside diameter of approximately 7.2 inches. The cavity section 44 is shaped like a section of a cone having a vertex angle of approximately 4.3 degrees.

A third cavity section 46 corresponds to the main body 32 and extends from the second section 40 to the slip fit section 34 and is cylindrical having an inside diameter of approximately 7.2 inches. The third cavity section 46 is designed to accommodate high explosives; the first 42 and second 44 cavity sections are designed to accommodate the unique tungsten ballast (see FIG. 1); and the threaded section 30 and slip fit section 34 are designed to accommodate the unique fuse well (see FIG. 1) of the present invention.

The case 12 may be welded together in sections, may be machined from solid stock, or may be cast. The novel design of the present invention is facilitated by a texture of slight grooves 48 that facilitate bonding of the tungsten ballast to the case 12 via high strength industrial epoxy adhesives.

Figure 3:
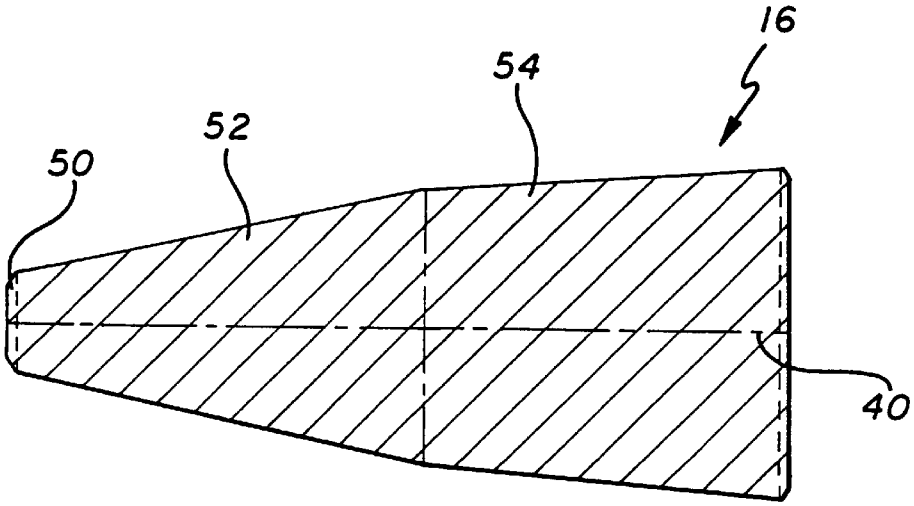
FIG. 3 is a more detailed cross-sectional diagram of the ballast of FIG. 2.

FIG. 3 is a more detailed cross-sectional diagram of the ballast 16 of FIG. 2. The ballast 16 includes a first conical section 50, a second conical section 52, and a third conical section 54. The first 50 and second 52 and conical sections fit the first cavity section of the missile case (see 42 of FIG. 2). The third conical section 54 fits the second cavity section of the missile case (see 44 of FIG. 2). The surfaces of the first 50, second 52, and third 54 conical sections are roughened to improve the bonding to the corresponding cavity sections.

The first conical section 50 extends approximately 0.24 inches from the end of the ballast 16 as the diameter expands from approximately 1.57 inches to 2.17 inches. The second conical section 52 extends approximately 8.8 inches from the end of the first conical section 50 as the diameter of the second conical section 52 expands from approximately 2.17 inches to approximately 5.98 inches. The third conical section 54 extends approximately 7.75 inches from the end of the second conical section 52 as the diameter expands from approximately 5.98 inches to approximately 7.18 inches. The total length of the ballast is approximately 16.8 inches.

Once the ballast 16 is installed in the case 12 of FIG. 2 the special polyethylene/polyalphaolefin liner is poured or sprayed on the interior of the case in preparation for the PBXN-109 explosives fill (see 22 of FIG. 2).

The ballast 16 is constructed of tungsten IAW MIL-T-21014D CLASS 4 cast and machined into the appropriate dimensions. The ballast 16 was designed to maximize ballast effectiveness while minimizing costs, however those skilled in the art will appreciate that other ballast shapes may be used without departing from the scope of the present invention. In addition, other ballast sizes and other materials such as lead or depleted uranium may be used without departing from the scope of the present invention.

Figure 4:
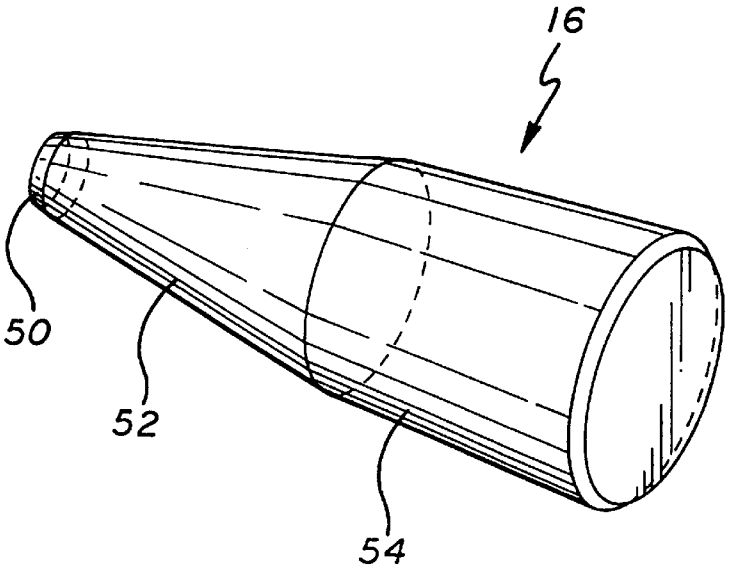
FIG. 4 is an isometric view of the ballast of FIG. 3.

FIG. 4 is an isometric view of the ballast of FIG. 3.

Figure 5:
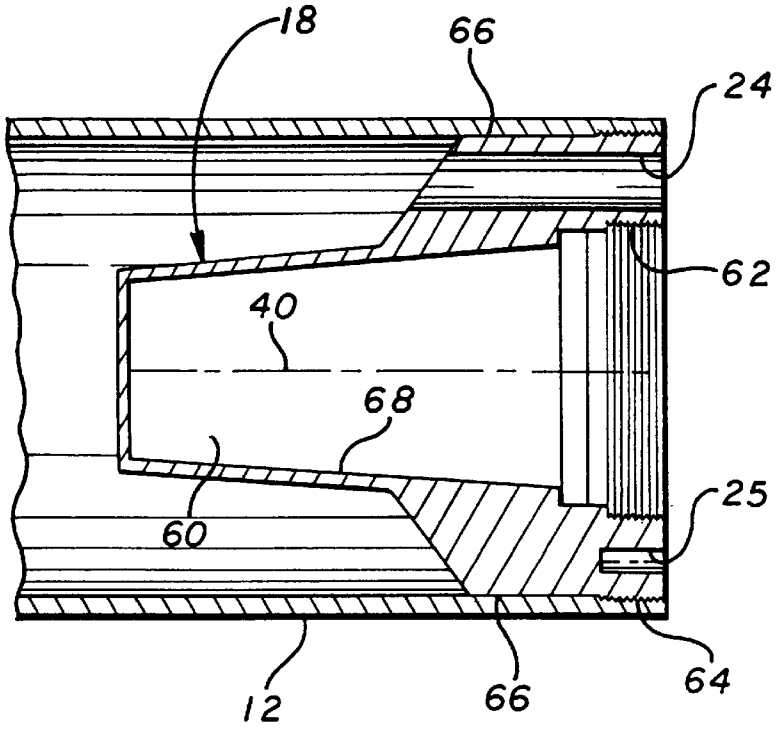
FIG. 5 is more detailed diagram of the fuse well of the warhead of FIG. 1.

FIG. 5 is more detailed diagram of the fuse well 18 of the warhead 10 of FIG. 1. The fuse well 18 includes a chamber 60 for housing a fuse and a booster charge (see FIG. 1) Internal threads 62 facilitate securing of the fuse in the chamber 60. External threads 64 help secure the fuse well 18 into the case 12 and match the threads 30 of FIG. 2. A slip fit portion 66 of the fuse well 18 is approximately 7.21 inches in diameter and fits into the corresponding slip fit section 34 of the case 12 of FIG. 2 providing additional structural support to the case. The additional support increases the ability of the warhead to survive high impact stresses while maintaining superior penetration performance.

In the event of accidental fire, the explosives blowout ports 24 allow heat to enter the warhead, burn explosives in the warhead, and allow gases from the burning explosives to safely vent out of the warhead. This reduces the probability of unintentional warhead detonation. The booster blowout ports 25 within the fuse body 19 serve a similar function as the explosives blowout ports 24 but are designed to prevent unintentional detonation of the fuse's booster charge.

The fuse well 18 is approximately 8.29 inches long. Chamber walls 68 are approximately, 0.09 inches thick. The outside diameter of the fuse well 18 is about 7.6 inches. The fuse well 18 may be cast in sections and welded together, may be cast as a single piece, or may be machined. The preferred construction material is 17-4 PH stainless steel with a passivate QQ-P-35 finish of type I, II, or III.

Figure 6:
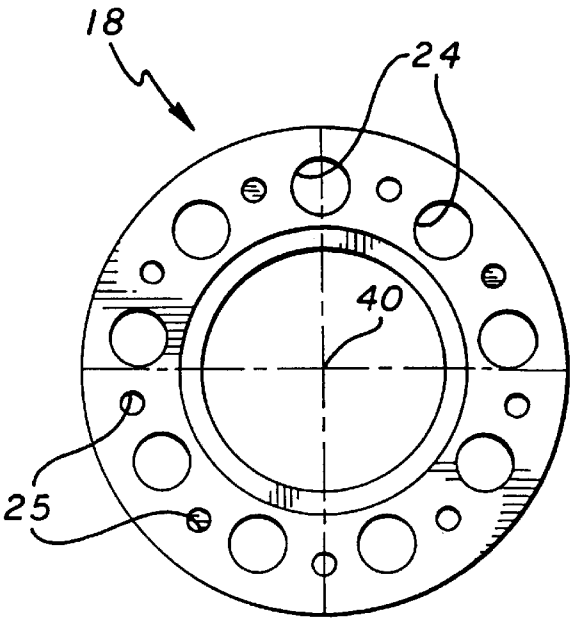
FIG. 6 is a back view of the fuse well of FIG. 5.

FIG. 6 is a back view of the fuse well 18 of FIG. 5. The explosives blowout ports 24 are co-axial with the longitudinal axis 40 of the warhead and are positioned around the circumference of the fuse well 18 and include 9 blowout ports placed in 40 degree intervals around the circumference. The 6 booster blow out ports 25 are an integral part of the fuse (see 19 if FIG. 1). The centers of the explosives blowout ports 24 are positioned approximately 2.9 inches from the longitudinal axis 40.

Figure 7:
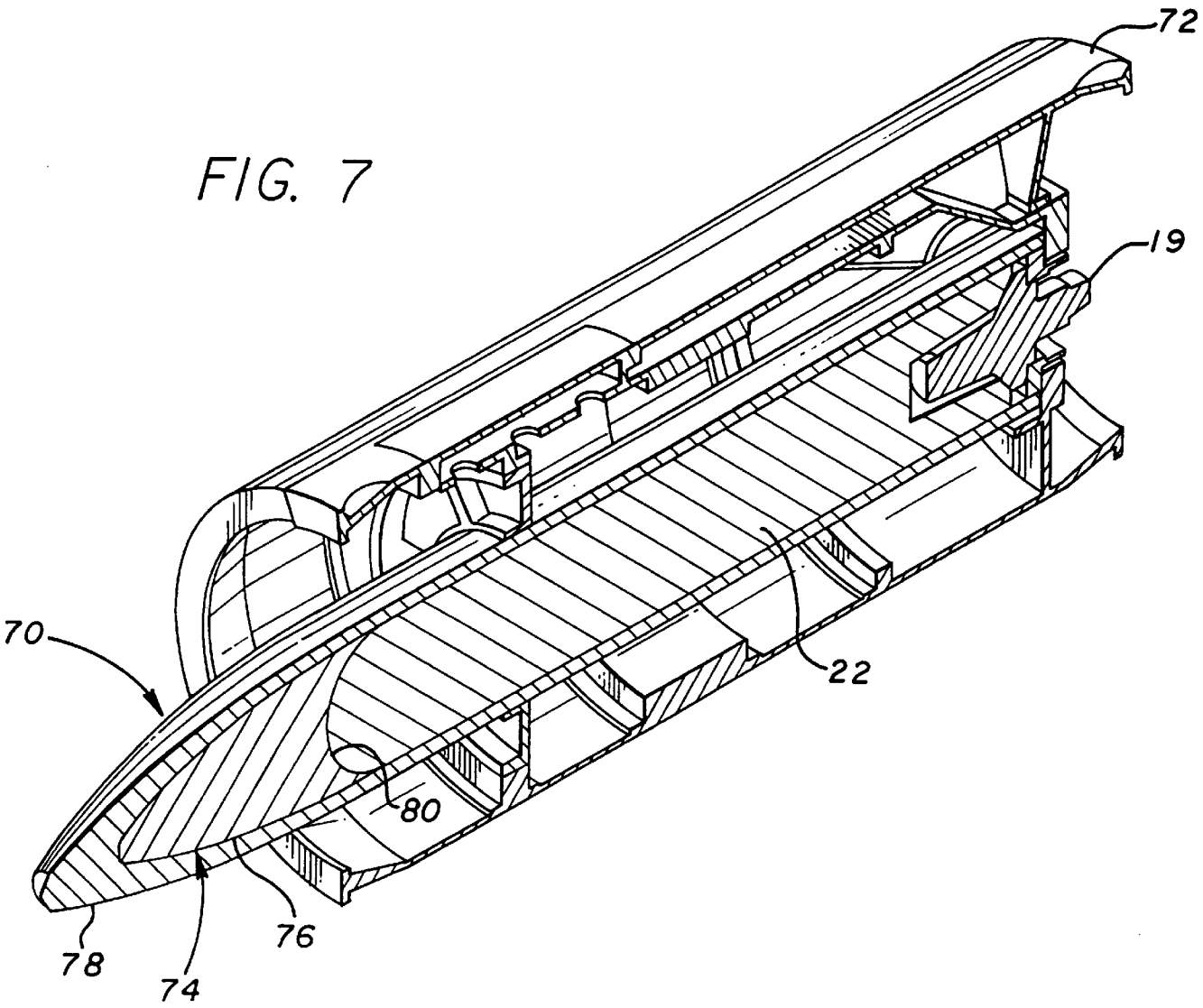
FIG. 7 is a three-dimensional cross-sectional diagram of an alternative embodiment of the warhead of the present invention secured in a Tomahawk payload section.

FIG. 7 is a three-dimensional cross-sectional diagram of an alternative embodiment 70 of the warhead of the present invention secured in a Tomahawk Cruise Missile payload section 72. The warhead 70 includes a tungsten ballast 74 having a front continuously tapered surface 76 and a rear indentation having a second tapered surface 80. The external dimensions of the warhead 70 are similar to those of the missile 10 of FIG. 1, and are limited by the pre-existing size of the Tomahawk payload section 72.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A missile warhead weighing more than 570 pounds having a length to diameter ratio of approximately 7, and a 6 caliber radius head nose comprising:

case means for containing explosives;

a tungsten ballast weighing approximately 240 pounds disposed within said case means for providing a high missile sectional pressure upon impact of said missile on a target;

detonating means disposed within the case means for detonating said missile explosives upon penetration of said target, and fuse well means attached to said case means at one end for housing said detonating means.

2. The invention of claim 1 further including support means for providing structural support to said case means for preventing dislodging of said fuse well means and said detonating means upon said impact of said missile warhead.

3. The invention of claim 2 wherein said support means includes a slip fit portion of said fuse well means that slips inside of said missile warhead case means reducing missile warhead case deformations due to slap down loads.

4. The invention of claim 1 further including safety means for inhibiting undesirable explosion or detonation of said missile warhead explosives by said detonating means and/or by exposure to heat.

5. The invention of claim 4 wherein said safety means includes blowout ports in said fuse well means.

6. The invention of claim 5 wherein said blowout ports include main explosive blowout ports for allowing said heat to burn said missile warhead explosives and safely vent gases resulting from said burning.

7. The invention of claim 6 wherein said main explosive blowout ports are placed around a circumference of said fuse well means and include nine ports having a surface area designed to minimize explosives explosion and/or detonation hazards.

8. The invention of claim 4 wherein said safety means includes a liner that lines the inside of said case means for improving fast cook-off performance in the event of an accidental fire or exposure to an extreme heat source.

9. The invention of claim 8 wherein said liner is polyethylene/polyalphaolefin.

10. The invention of claim 1 wherein said missile explosives include PBXN-109.

11. The invention of claim 1 wherein said case means includes a textured or grooved surface for facilitating bonding of said ballast means to said case means.

* * * * *